United States Patent [19]

Bergmann et al.

[11] Patent Number: 4,843,558

[45] Date of Patent: Jun. 27, 1989

[54] REGULATION FOR A GAS ENGINE

[75] Inventors: Horst Bergmann, Esslingen; Helmut Daudel, Schorndorf; Burkhard Brandner, Werdohl; Klemens Klueppel, Neuenrade, all of Fed. Rep. of Germany

[73] Assignees: Daimler-Benz Aktiengesellschaft; Atlas Fahrzeugtechnik GmbH, both of Fed. Rep. of Germany

[21] Appl. No.: 67,276

[22] Filed: Jun. 29, 1987

[30] Foreign Application Priority Data

Jun. 27, 1986 [DE] Fed. Rep. of Germany ..... 3621500

[51] Int. Cl.[4] ..... F02D 5/145; F02D 43/00

[52] U.S. Cl. ..... 364/431.03; 364/431.04; 123/489

[58] Field of Search ..... 364/431.01, 431.02, 364/431.03, 431.04, 431.05, 431.06, 431.07, 431.11, 431.12; 123/406, 486, 415, 417, 418, 489

[56] References Cited

U.S. PATENT DOCUMENTS

| | | | |
|---|---|---|---|
| 4,140,085 | 2/1979 | Rabus et al. | 123/489 X |
| 4,245,312 | 1/1981 | deVulpillieres | 364/431.07 |
| 4,501,250 | 2/1985 | Qmori et al. | 123/486 |

FOREIGN PATENT DOCUMENTS

| | | |
|---|---|---|
| 2936422 | 3/1981 | Fed. Rep. of Germany . |
| 3116593 | 11/1982 | Fed. Rep. of Germany . |
| 3302428 | 5/1984 | Fed. Rep. of Germany . |
| 3519476 | 12/1986 | Fed. Rep. of Germany . |

OTHER PUBLICATIONS

"Automotive Handbook" (2nd ed.), ©1986 Robert Bosch GmbH, Stuttgart, Federal Republic of Germany; pp. 1,361,443

Von Helmut Schwarz et al.-"Bosch Technische Berichte" (Bosch Technical Reports), No. 2, 1981; pp. 139-151.

*Primary Examiner*—Marvin L. Nussbaum

*Attorney, Agent, or Firm*—Barnes & Thornburg

[57] ABSTRACT

A regulation for a gas engine with a rotational speed probe for the crankshaft rotational speed, with a rotational speed-load-ignition angle-performance graph memory read out during each crankshaft rotation, with an ignition pulse generator controlled by the performance graph memory, with a lambda-probe, with a load probe, with a vacuum-controlled gas pressure adjusting device for the propulsion gas and with a flow-mixing device for the propulsion gas and the air. The invention provides a regulation for a gas engine which offers a full utilization of the possibilities of the gas engine above all in lean operation and in the partial load range. A rotational speed-load-lambda-performance graph (36) is provided for producing lambda-desired values. The lambda-desired values readied by the rotational speed-load-lambda-performance graph (36) are compared with the lambda-actual values under formation of a lambda difference value. For the adaptation of the ignition angle to the respective lambda actual value a lambda-difference value-load-ignition angle correction value performance graph (29) produces an ignition angle correction value which is added to the base ignition angle value of the rotational speed-load-ignition angle-performance graph (27), respectively, is subtracted therefrom.

17 Claims, 9 Drawing Sheets

107
53
VENTURI
AUXILIARY VALVE
112
ATM
109
107

102
105
108
106
GAS
ATM
101
ADJUSTING VALVE
104
DIAPHRAGM BOX
103
22

REGULATION FOR A GAS ENGINE

BACKGROUND AND SUMMARY OF THE INVENTION

The present invention relates to a regulation for a gas engine with a rotational speed probe for the crankshaft rotational speed, with a memory of rotational speed-load-ignition angle performance graph (family of characteristic curves) read out during each crankshaft rotation with an ignition pulse generator controlled by the performance graph memory, with a lambda probe, with a load probe, with a vacuum controlled gas-pressure-adjusting device for the propulsion gas and with a gas-mixing device for the propulsion gas and air.

A gas engine offers a greater potential for the lean operation than a conventional Otto engine. This entails considerable advantages of the gas engine as regards fuel consumption and harmful component emission, especially in the partial load operation.

The mixture preparation with customary gas-mixing devices is disadvantageous as regards the flow resistance, the regulating ability and the failure susceptibility. It is also hardly possible with a control system to utilize the complete engine performance graph, especially if one desires to include the engine ignition. A control in particular does not assure optimum lambda values.

In "Bosch Technische Berichte"["Bosch Technical Reports"], 1981, No. 3, pages 139 to 151, reference is made to the use of an ignition performance graph (set of characteristic curves) and of a lambda performance graph (set of characteristic lambda curves) for the engine control. However, a control is possible in this manner only within a coarse raster.

The object of the present invention is the provision of a regulation for a gas engine which offers a complete utilization of the possibilities of the gas engine above all in the lean operation and in the partial load operation.

The underlying problems are solved according to the present invention in that a rotational speed-load-lambda-performance graph (set of characteristic curves) is provided for producing lambda-desired values, in that the lambda-desired values obtained from the rotational speed-load-lambda performance graph are compared with the lambda-existing values under formation of a lambda difference value, in that for the adaptation of the ignition angle to the respective lambda-actual value, a lambda-difference value-load-ignition angle correction performance graph produces an ignition angle correcting value which is added to the base ignition angle value of the rotational speed-load-ignition angle-performance graph, respectively, is subtracted therefrom.

The regulation of this invention differs from the state of the art insofar as a correction value on the basis of the measured lambda difference value is superimposed on the respective values of the base performance graphs for ignition angle and lambda value. As a result thereof, a regulation is superimposed on the control by the base performance graphs which compares the lambda-actual value with the lambda-desired value. The ignition angle is matched to the actual value of the engine and the mixture formation is corrected with a view toward the lambda-desired value. All characteristic values of the performance graphs, inclusive the correcting values, are stored as multi-bit terms or values in address locations of a memory unit so that they can be read out under the control of the input values (input signals) and can be combined in counters. These operations require no complicated and time-consuming calculation so that all adjusting values for the engine can be made available correctly in time during an operating period or cycle. The regulation also utilizes stored performance graphs (set of characteristic curves) of digital values.

A further feature of the present invention is characterized in that for the adaptation of the lambda value to different mixtures a rotational speed-load-lambda-correction performance graph is provided whose output values serve for the correction of the lambda-desired value.

One embodiment of the control of the gas pressure adjusting device provides that an adjusting valve is provided for the control of the vacuum for a diaphragm of the gas pressure adjusting device whereby the adjusting value is stored in a rotational speed-load-adjusting value-performance graph, and in that the diaphragm controls a valve body which releases the gas flow from a line into a gas line terminating in the venturi section of the gas-mixing device.

With the use of an adjusting valve controlled by current value, provision is made according to the present invention that the adjusting value is a current value for the adjusting valve.

A further embodiment of the gas pressure adjusting device of the present invention is characterized in that a gas valve flap is built into a line of the gas pressure adjusting device terminating in the gas-mixing device, whose adjusting value is stored in a rotational speed-load-adjusting value performance graph, and in that the diaphragm of the gas pressure adjusting device is acted upon with a constant vacuum and keeps open a valve body which controls the gas flow into the line.

With the use of a gas valve flap provision is made in the present invention that the adjusting value is an angle value for a gas valve flap.

A correction of the adjusting value thus leads to a regulating behavior that in addition to the rotational speed-load-adjusting value-performance graph, a lambda difference value-load-correcting value-performance graph is Provided whose correction values are added to the value of the base performance graph, respectively, are subtracted therefrom.

A further optimization is obtained by the present invention in that further correction performance graph as a function of the mixture pre-selection and of the acceleration conditions are provided whose correction values are added to the base values for ignition angle and gas-pressure adjusting device, respectively, are subtracted therefrom.

A control of the gas-mixing device also within the range of small through-flow becomes possible in that in addition to a main throttling device, a pre-throttling device is provided.

A particularly advantageous construction of the pre-throttling device is obtained in that the pre-throttling device is constructed as double-roller slide valve with adjustable cross-section which is effective in the lower through-flow range.

BRIEF DESCRIPTION OF THE DRAWINGS

These and other objects, features and advantages of the present invention will become more apparent from the following description when taken in connection with the accompanying drawing which shows, for purposes of illustration only, several embodiments in accordance with the present invention, and wherein.

DETAILED DESCRIPTION OF THE DRAWINGS

Figure 1:
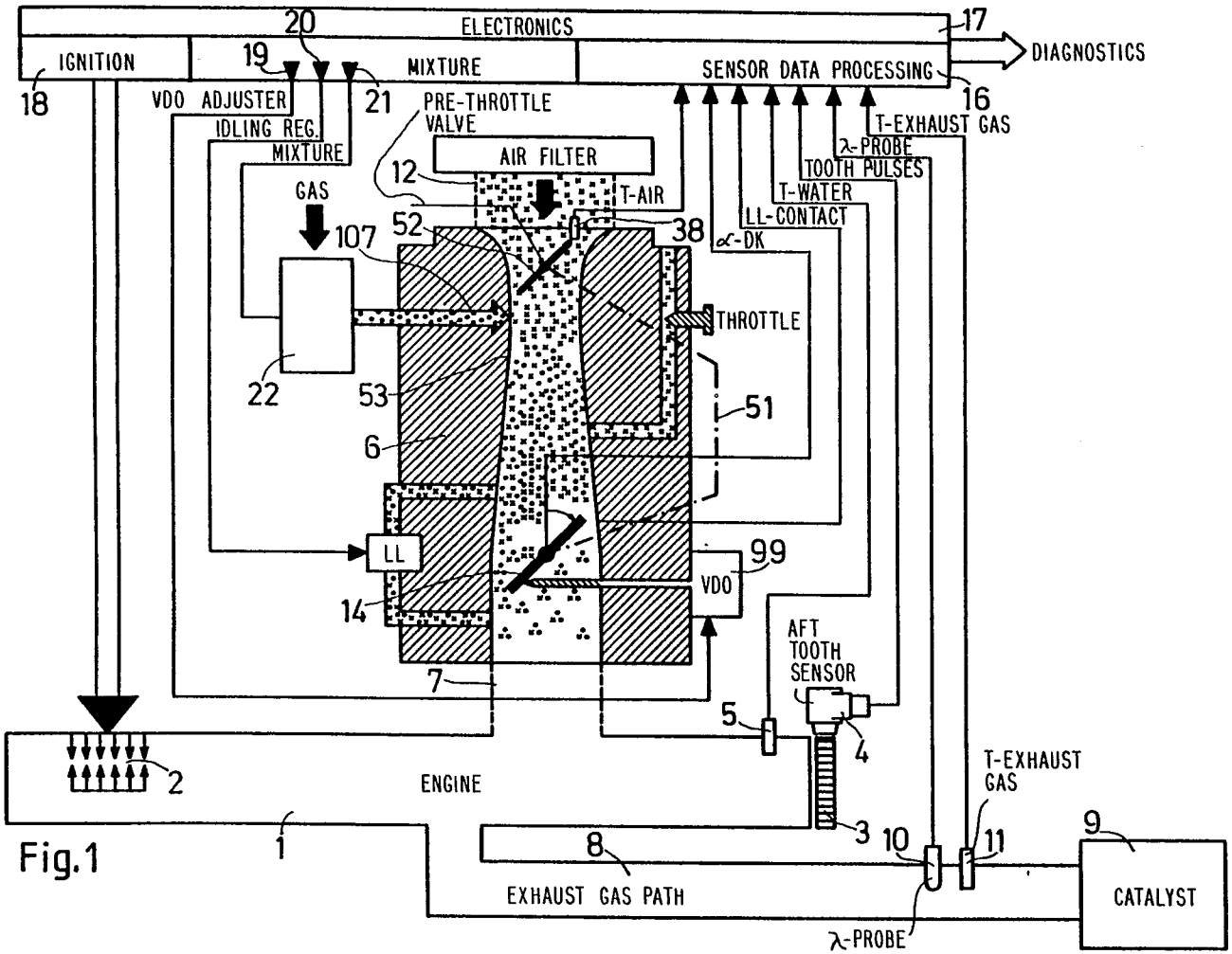
FIG. 1 is a block diagram of a gas engine with a regulation in accordance with the present invention.

Referring now to the drawing wherein like reference numerals are used throughout the various views to designate like parts, and more particularly to FIG. 1, a gas engine 1 is constructed, for example, as six-cylinder engine with six ignition gaps 2. A toothed rim 3 is seated at the crankshaft (not shown) of the gas engine 1, for example, the starter pinion rim whose teeth are detected by a tooth sensor 4, see also FIG. 9. The tooth sensor 4 evaluates the signals and produces for each tooth a tooth pulse for further processing. The tooth pulses can also possibly be multiplied.

The gas engine 1 is equipped with a temperature probe 5 for the cooling water temperature and with a temperature probe 38 for the suction air temperature. The mixture preparation takes place in a gas-mixing device 6. Air is sucked in by way of an air suction channel 12. Gas is conducted from a gas tank (not shown), after a corresponding pressure reduction by way of a gas pressure adjusting device 22 and a gas line 107, to a venturi section 53 of the gas-mixing device 6. A suction channel 7 of the gas engine 1 adjoins the gas-mixing device 6.

The discharge side of the gas engine 1 leads to an exhaust channel 8 to which is connected a catalyst 9. A lambda-probe 10, on the one hand, and a temperature probe 11 for the exhaust gas temperature, on the other, is provided in the exhaust gas channel 8. Separate lambda probes may also be provided for different branches of the exhaust gas channel.

The gas-mixing device 6 contains a main throttling device 14 and a pre-throttling device 52 which are so coupled with one another or so connected with one another by a coupling device 51 that the pre-throttling device 52 is operable only in the lower range of the through-flow when the main throttling device 14 is nearly closed. As a result thereof, a pressure reduction is produced in the venturi section 53 also for the lower through-flow range which suffices as suction pressure for the control, respectively, regulation of the gas supply and can be measured completely satisfactorily. Both throttling devices are constructed as throttle valves. The coupling 51 takes place mechanically or by way of electronic adjusting members so that the two throttling devices 14 and 52 operate overlappingly and can be each so adjusted that a sufficient suction vacuum is available inside of the venturi section 53 over the entire through-flow range.

A rotational speed-limiting device 99 cooperating with the main throttling device is provided for the rotational speed limitation.

Figure 2:
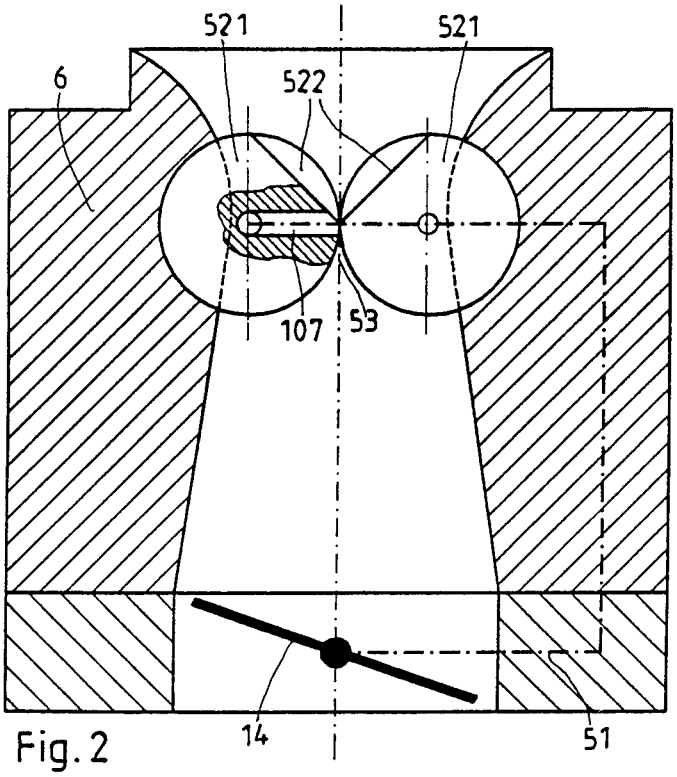
FIG. 2 is a somewhat schematic cross-sectional view through a modified embodiment of a gas-mixing device in accordance with the present invention.

FIG. 2 illustrates one embodiment of the gas mixing device 6 with a double-roller slide valve 521 having oppositely rotating rollers as pre-throttling device. The rollers are coupled with one another to rotate in opposite direction and have profiled circumferential grooves 522 for the formation of a venturi section 53 as is schematically indicated. The gas line 107 terminates in the circumferential groove 522 of one or both rollers of the double roller slide valve 521 and more particularly the gas line 107 terminates at the narrowest place of the venturi section 53. The main throttling device 14 is constructed as throttle valve.

Figure 3:
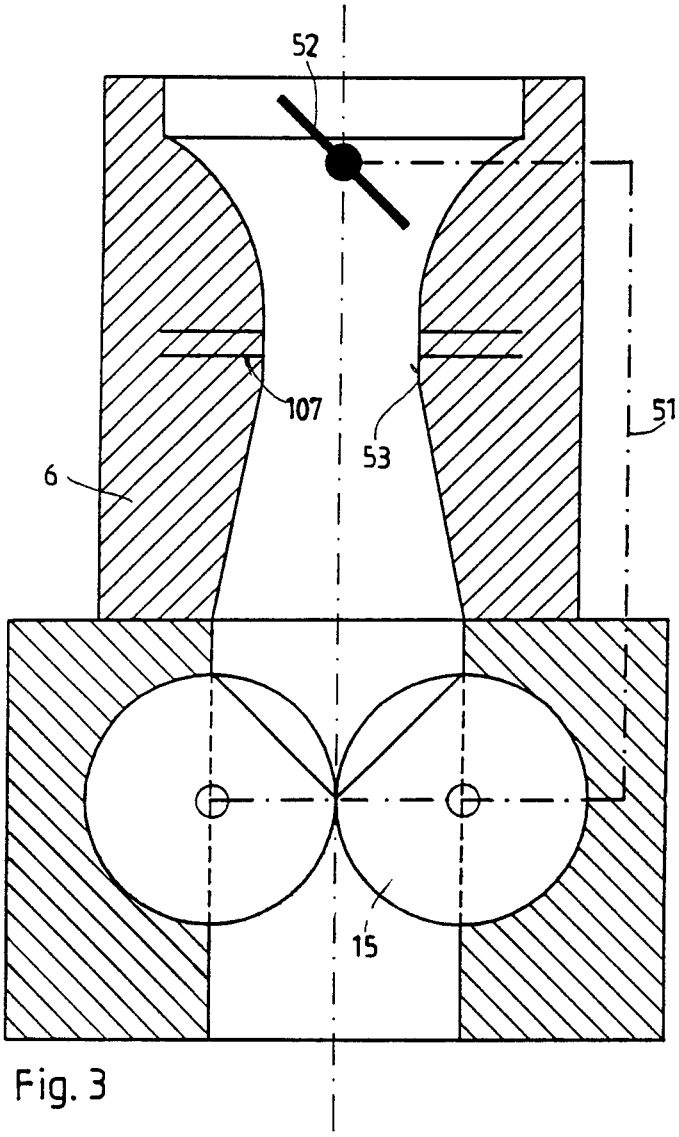
FIG. 3 is a somewhat schematic cross-sectional view through another modified embodiment of a gas-mixing device in accordance with the present invention.

According to a modified construction of the gas-mixing device according to FIG. 3, the main throttling device is constructed as double-roller slide valve 15. This double roller slide valve is effective over the entire through-flow range whereas the pre-throttling device 52 in the form of a throttle valve is operable only in the lower through-flow range.

Figure 4:
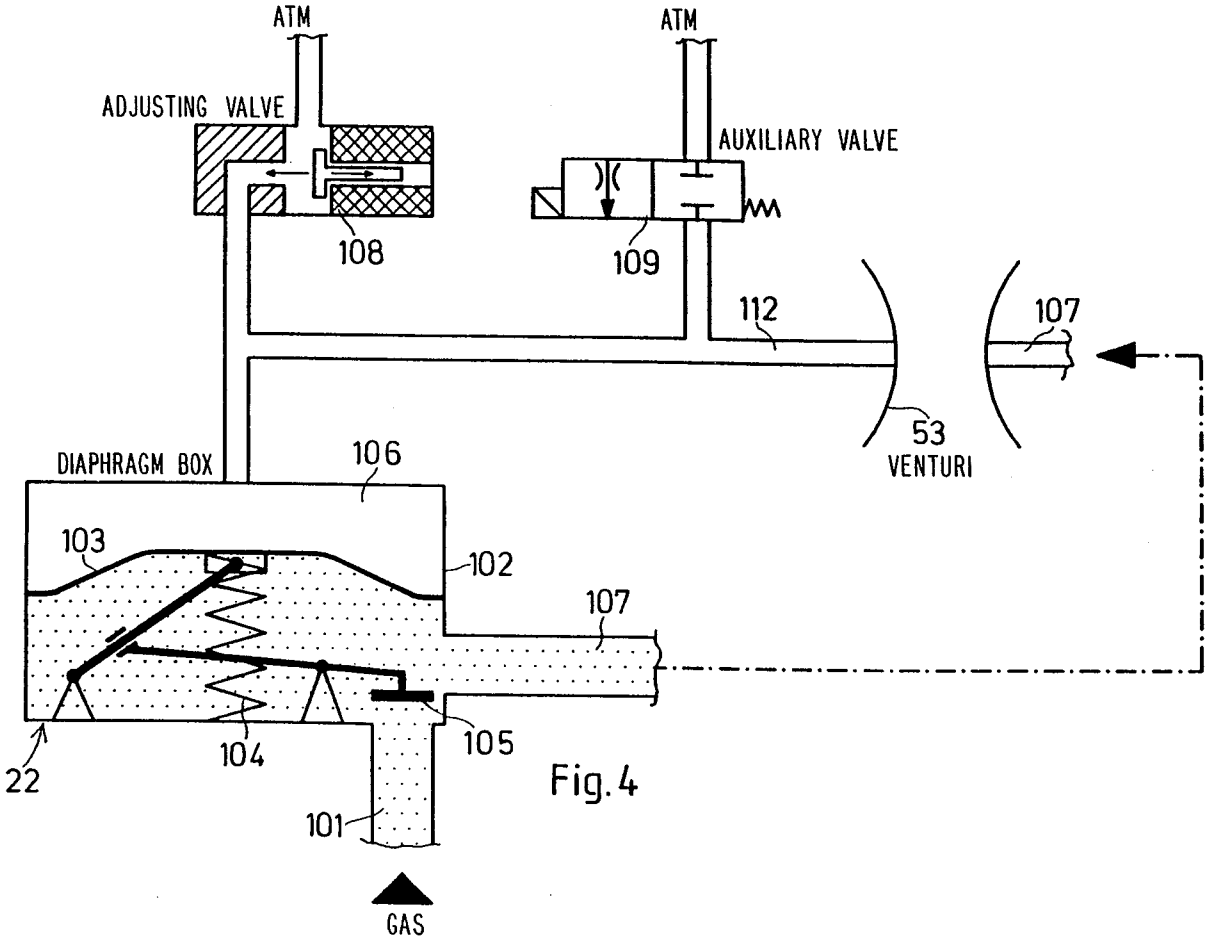
FIG. 4 is a schematic view of the control of the gas pressure adjusting device in accordance with the present invention.

FIG. 4 illustrates one embodiment of the gas pressure adjusting device. The gas reduced to normal pressure is conducted by way of a line 101 to a vacuum-controlled diaphragm valve 102 whose outlet terminates in the venturi section 53 by way of the gas line 107. The diaphragm 102 is prestressed by a compression spring 104 and acts by way of a linkage on a valve body 105. When no vacuum prevails in the vacuum chamber 106, i.e., when atmospheric pressure is present in this vacuum chamber 106 the compression spring 104 is compressed, the valve body 105 is lifted off its valve seat and the gas supply is opened as long as a vacuum is effective in the gas line 107. With a missing vacuum in the gas line 107, the valve body 105 keeps the line 101 closed.

The vacuum chamber 106 is acted upon by the vacuum in the venturi section 53. Additionally, a controllable adjusting valve 108 is provided whose valve body is adjustable steplessly. Corresponding to the adjustment or control of this adjusting valve 108, the pressure difference with respect to the atmospheric pressure, i.e., the vacuum pressure, can be reduced so that as a result thereof, the supplied gas quantity can be increased. The input values for the adjustment of the adjusting valve 108 are read by the gas mixture control and assure an optimum mixture formation. An auxiliary valve 109 is provided for special operating conditions. In the open position, the auxiliary valve 109 effects a calibrated flow for the vacuum adjustment.

The coordination of the adjusting valve 108 and of the auxiliary valve 109 to the different operating conditions is indicated in the following table:

| | Adjusting Valve 108 | Auxiliary Valve 109 |
|---|---|---|
| Normal Operation | Opened | Closed |
| Coasting Operation | Closed | Closed |
| Ignition Off | Closed | Closed |

-continued

| | Adjusting Valve 108 | Auxiliary Valve 109 |
|---|---|---|
| Emergency Operation | Closed | Open |

When the adjusting valve 108 is opened, a current control of the valve displacement and therewith of the opening takes place. The auxiliary valve 109 can be switched exclusively between the mentioned conditions.

Figure 5:
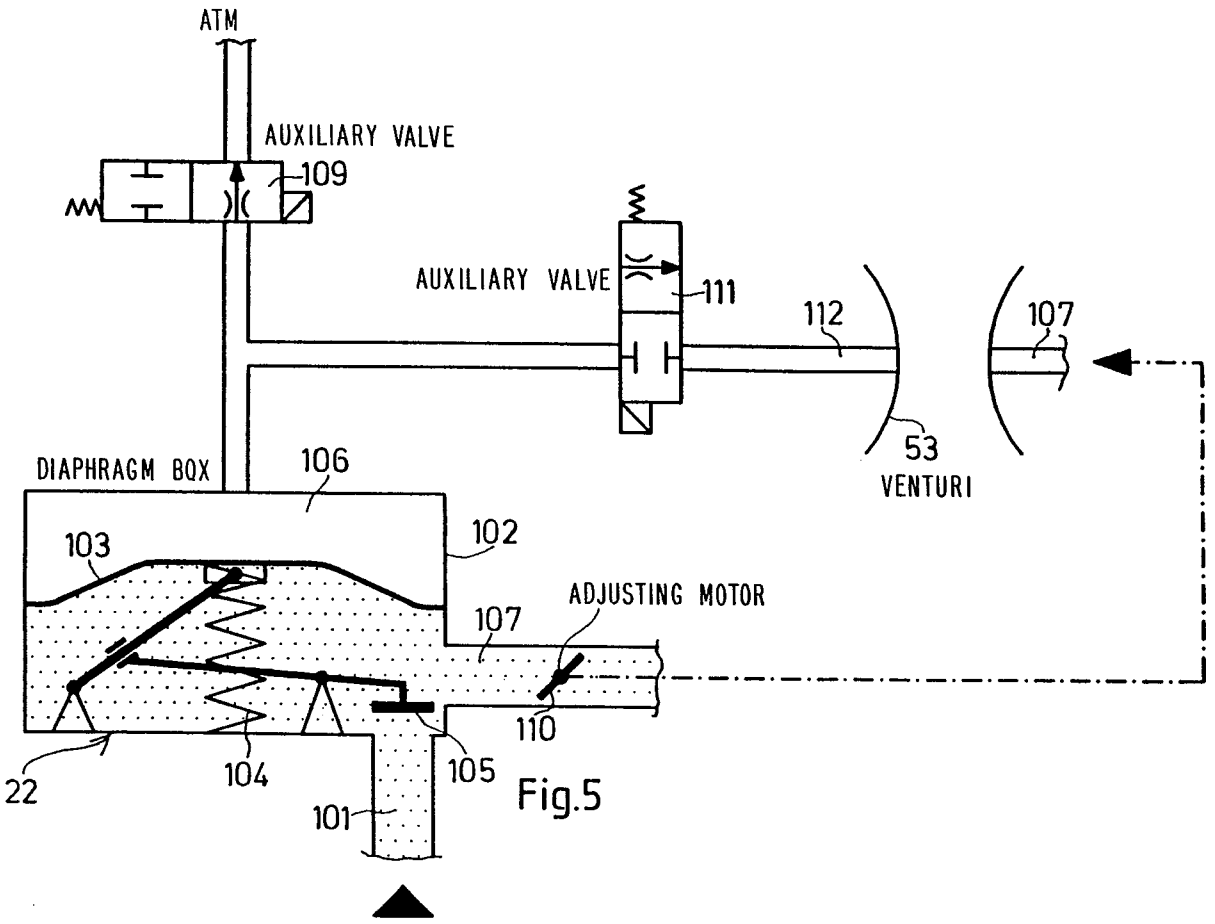
FIG. 5 is a schematic view of a modified embodiment of the control of the gas pressure adjusting device in accordance with the present invention.

A further embodiment of a gas pressure adjusting device 22 is illustrated in FIG. 5. In this embodiment, a gas valve flap 110 is installed into the gas line 107 which is actuated by an adjusting motor (not shown). The gas flow is controlled by the angular position of the gas valve flap 110.

Two auxiliary valves 109 and 111 with calibrated through-flow are connected to, respectively, inserted into the line 112. The coordination of the shifting conditions of these auxiliary valves to different operating conditions is indicated in the following table:

| | Gas Valve Flap | Auxiliary Valve 111 | Auxiliary Valve 109 |
|---|---|---|---|
| Normal Operation | Operating Position | Closed | Opened |
| Coasting Operation | Closed | Opened | Closed |
| Ignition Off | Emergency Position | Opened | Closed |
| Emergency Operation | Emergency Position | Opened | Opened |

In the operating position of the gas valve flap 110, the angular position thereof is controlled. In the emergency position, a fixed position is used with the gas valve flap.

Figure 6:
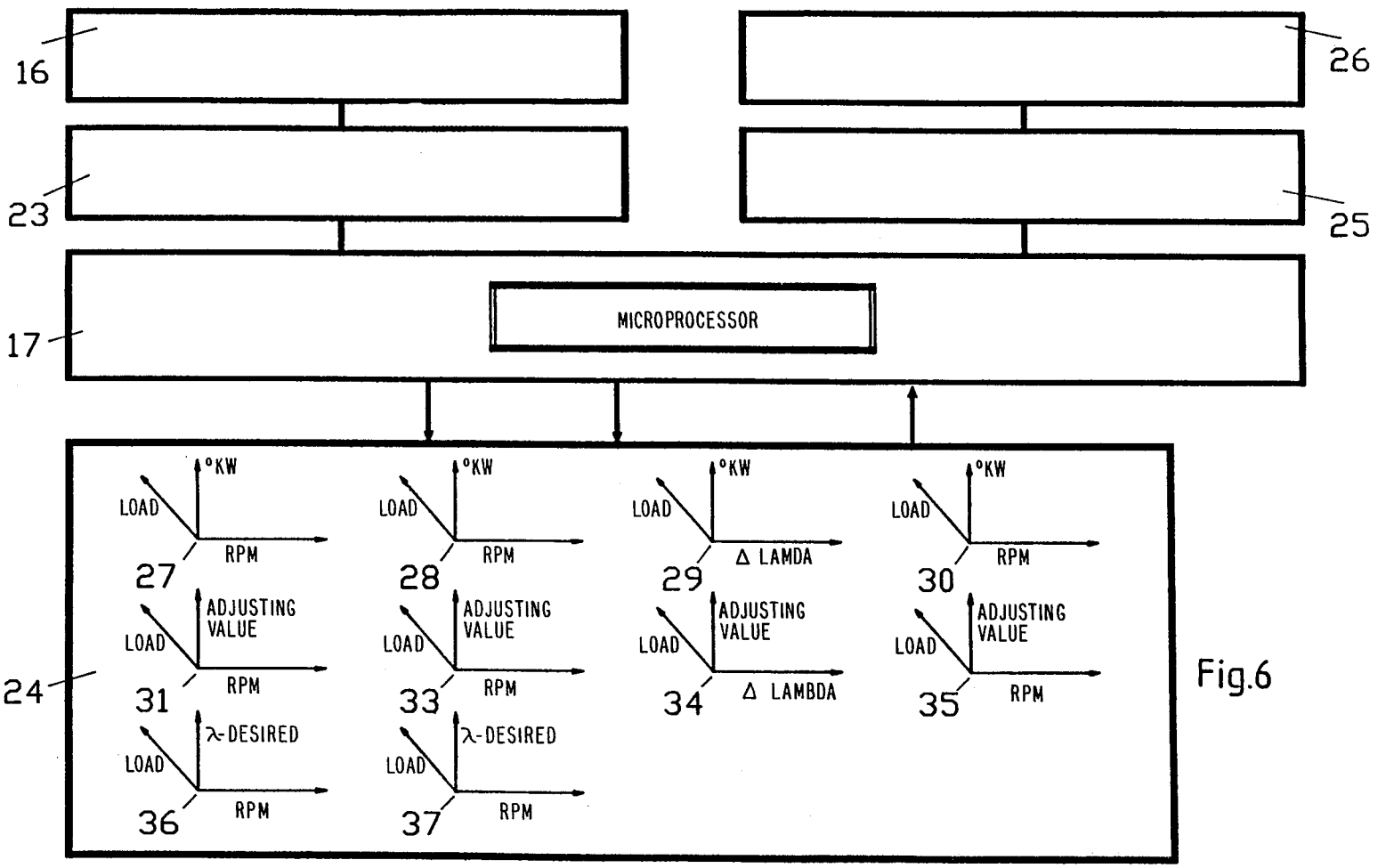
FIG. 6 is a block diagram of the electronic component stages in accordance with the present invention.

FIG. 6 illustrates a block diagram of the electronic components. The signal lines of the mentioned probes as well as of further sensors for the position of the throttle valve (potentiometer) are inputted as input signals into an input circuit 16. The measured signals are formed in the input circuit 16 and are also converted, especially are digitalized. The input circuit 16 is connected with a microprocessor 17. An ignition stage 18 as well as mixing control are connected to the output of the microprocessor 17 (FIG. 1). The output lines 19, 20 and 21 provide adjusting signals for the rotational speed limitation, for the idling regulation and for the gas pressure adjusting device 22. Additionally, an emergency operating function is provided which, in case of a failure function becomes operable, see also FIG. 1.

Figure 7:
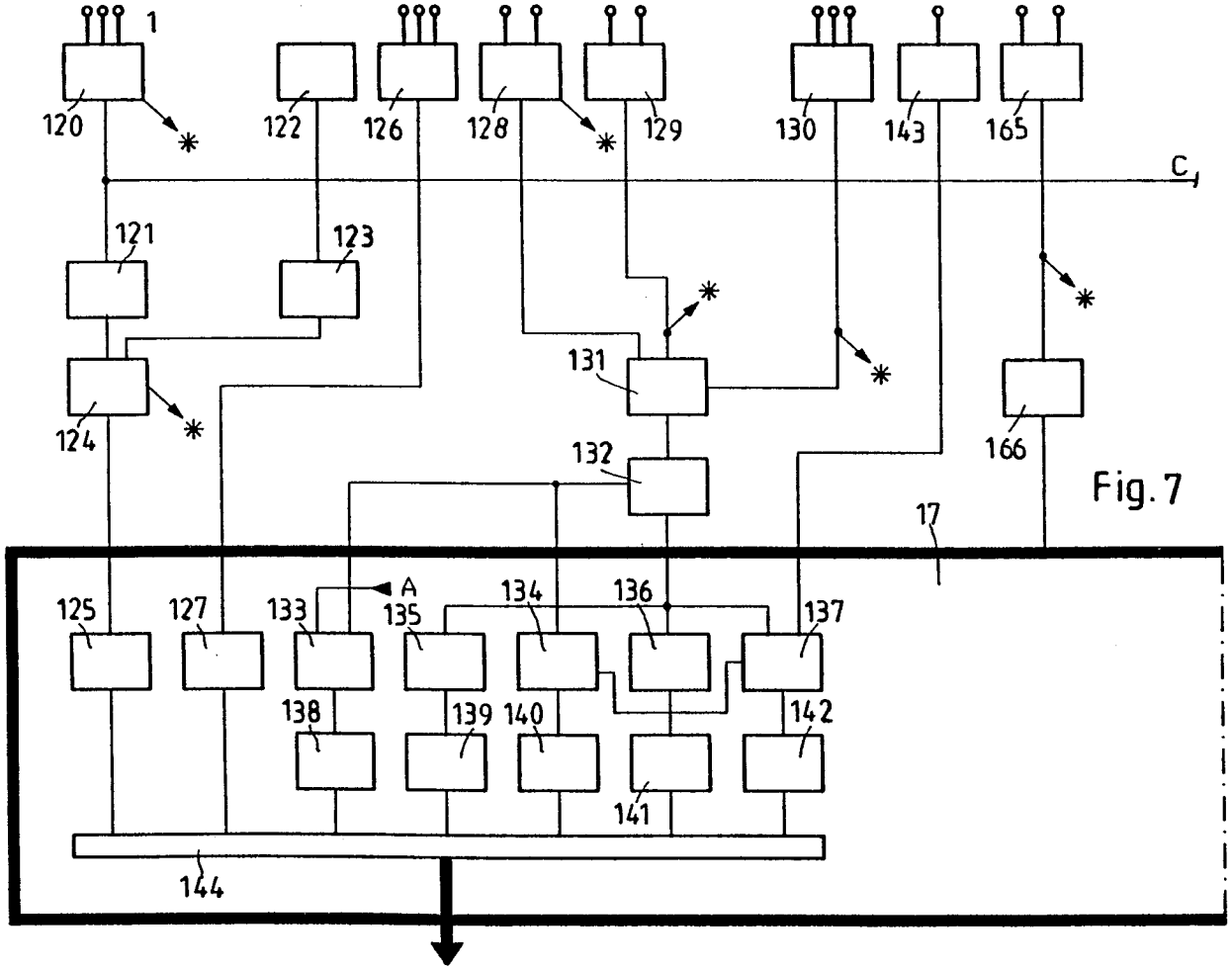
FIG. 7 is a schematic view of components in the left upper half of the block diagram of FIG. 6.
Figure 8:
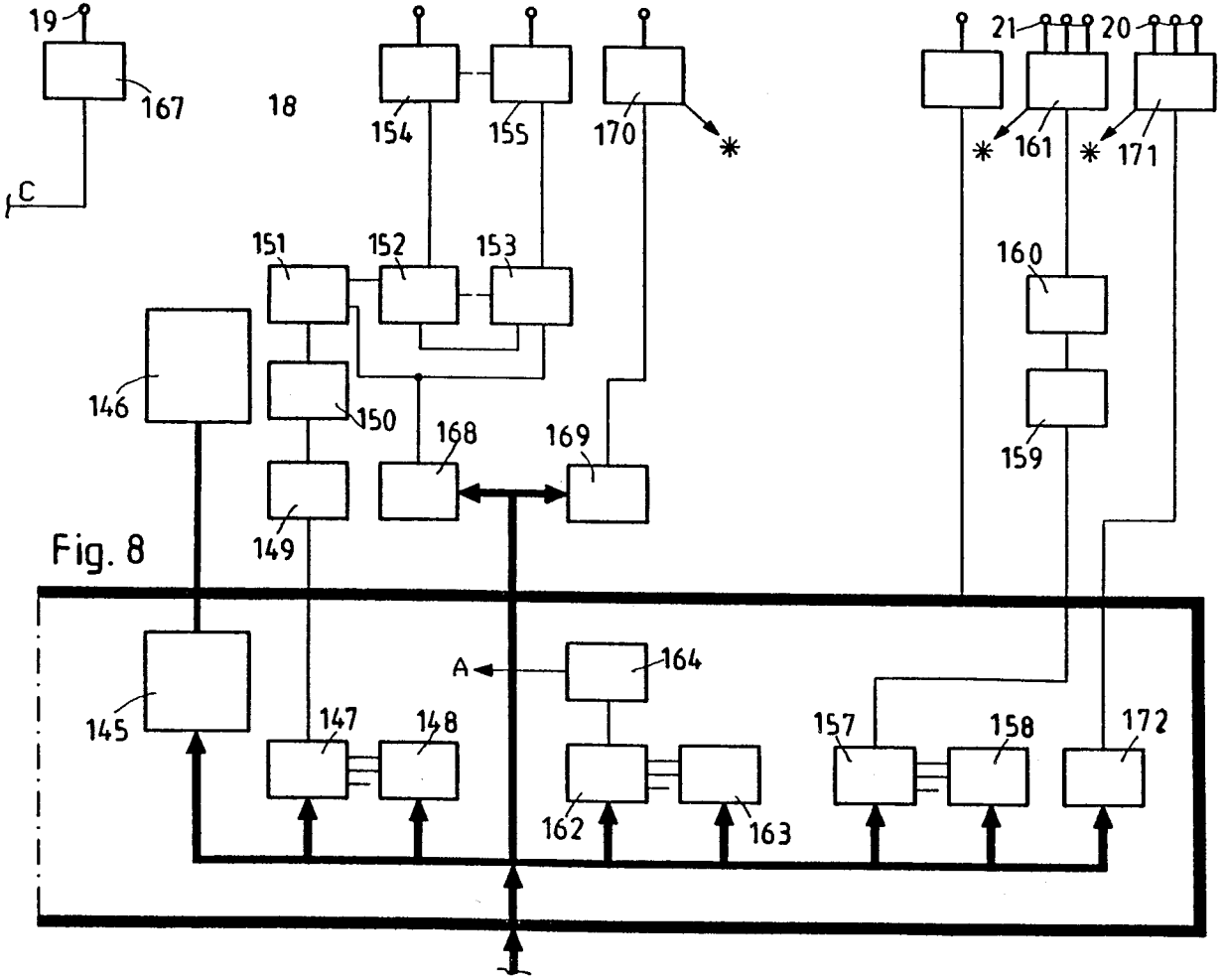
FIG. 8 is a schematic view of components in the right upper half of the block diagram of FIG. 6.
Figure 9:
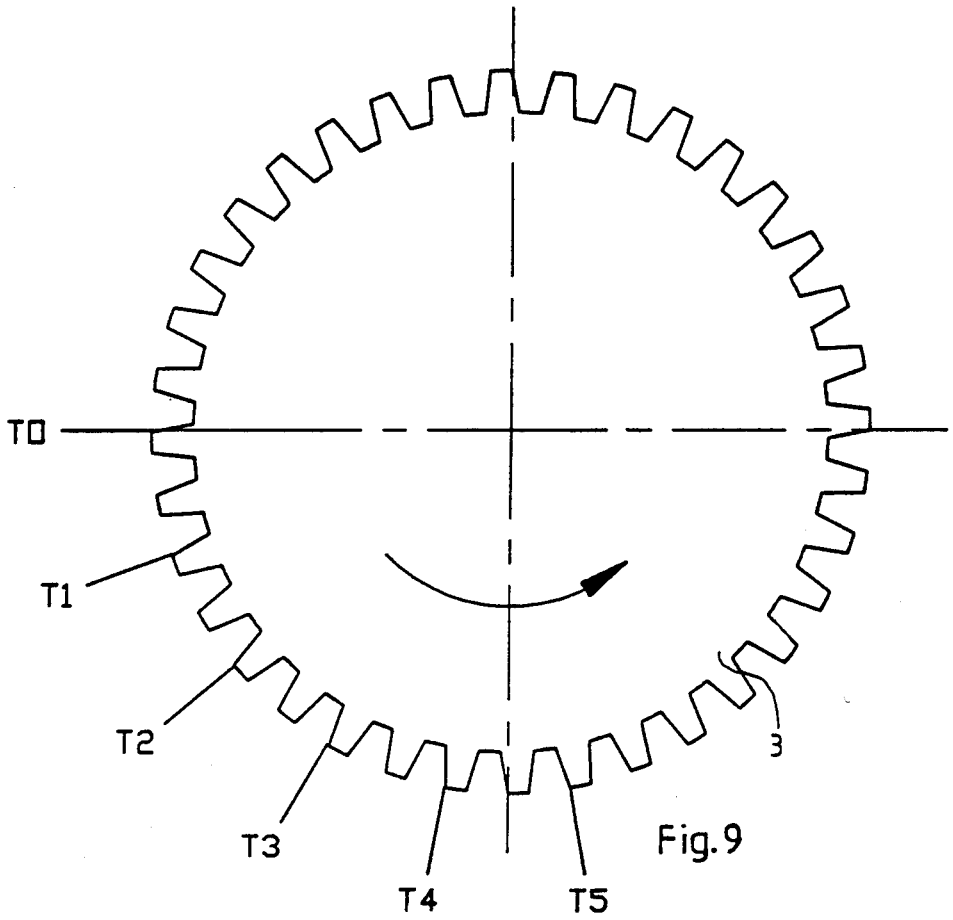
FIG. 9 is a somewhat schematic view of a toothed rim for explaining the regulating operation as a function of crankshaft rotation in the system of the present invention.

The input circuit 16 serves for receiving and evaluating the different input signals. The input signals are read out by the microprocessor 17 staggered by way of a multiplexing stage 23. The microprocessor 17 utilizes these signals as address signals for a memory unit 24 which contains in numerous performance graphs multi-bit signals for different operating conditions and also correction signals as will be explained more fully hereinafter. These multi-bit signals are then transferred to a correcting stage 25 and are combined into correction values. The output values are finally readied in an output circuit 26. The entire control of the electronic components takes place by the microprocessor. FIG. 7 illustrates in detail the upper left half of the circuit according to FIG. 6 with the input stages and the time multiplexing stages. The corresponding output part in the upper right half of FIG. 6 is illustrated in FIG. 8. FIG. 9 explains the program sequence in time by reference to a toothed rim 3 coupled with the crankshaft.

The (*) connections indicated in FIGS. 7 and 8 are intended for diagnostic purposes and will not be explained further herein.

In detail, the input stage includes a tooth pulse interface 120 which evaluates the output values of the tooth sensor 4. This tooth pulse interface 120 contains pulse transformer stages and additionally a circuit for producing a reference pulse at a reference angle T0 of the crankshaft rotation, see FIG. 9. The tooth pulses are doubled in a doubler 121. However, also another type of multiplier which multiplies the pulses with a different factor can be used. One therefore obtains in the output of the doubler 121 angle pulses. An oscillator 122 produces timing pulses which are each counted in a time base circuit 123. The time base circuit 123 counts, starting from a predetermined angular pulse, a fixed time basis so that with the aid of the tooth pulses in the output of the doubler 121 the rotational speed can be determined in a counter circuit 124. The rotational speed is proportional to the number of the angle pulses counted during the time base. The respective rotational speed value is held as a seven-bit term or value in a memory 125. The rotational speed is determined during each crankshaft rotation.

A characteristic value for the respective fuel of the engine can be adjusted by way of a mixture-adjusting stage 126. This mixture adjusting stage 126 therefore allows an adjustment to that type of gaseous fuel for which the engine is provided. Eight adjustments are possible whereby the adjusting values are stored in a three-bit memory 127. These memory values remain unchanged because the mixture-adjusting stage 126 is fixedly adjusted for an engine corresponding to the provided fuel.

The input values for the suction air temperature, for the lambda value and for the throttle valve position which are a measure for the load, are received in the input stages 128, 129 and 130. Possibly also other characteristic values (parameters) such as cooling water temperature, exhaust gas temperature and other magnitudes can be evaluated and inputted. These input stages are read out by way of a multiplexing circuit 131 and are converted in a A/D converter 132 into digital values. The multiplexing stage 131 is controlled by the microprocessor 17 so that the values are always available correct in time within an operating period. The values are further processed by way of comparators 133, 134 and intermediate memories 135, 136, 137 which are also multiplex-controlled. The comparator 133 compares the respective lambda actual value with a lambda desired value which is inputted by way of the connecting point A and whose formation will be explained more fully hereinafter. On the basis of the comparison, one obtains a six-bit lambda differential value which is readied for use in a memory 138. If the difference value determined in the comparator 133 drops below a lower threshold value, no new value is inscribed into the memory 138 in order that the necessary correction for the existing lambda difference always takes place. The suction air temperature is always transferred by way of an intermediate memory 136 as a six-bit term or value to a memory 139. The six-bit temperature value permits a temperature resolution of about 2° C. and a correspondingly accurate determination of one or several threshold values for the selection of different performance graphs as will be explained more fully hereinafter.

The angle position of the main throttle device is read out by means of a potentiometer or another transmitter and is transferred to an input stage 130.

Load changes are determined in the comparator 134 from the positions of the main throttle device in sequential operating periods. A three-bit acceleration value is formed therefrom which is stored in a memory 140.

The lambda value is transferred by way of an intermediate memory 136 as a six-bit term or value into a memory 141. Finally, the actual load value is received as a six-bit term or value in a memory 142 by way of an intermediate memory 137. A throttle valve switch produces a signal when the throttle valve is closed. This signal is transferred to an input stage 143 and is present at the intermediate memory 137 in order that the value of the throttle valve switch for the closed throttle valve is transferred with priority.

The measured value of the temperature probe 11 for the exhaust gas temperature is transferred to an input stage 165. The temperature value is compared in a comparator 166 with a threshold value, at which the lambda probe and therewith the regulation are turned on when the engine has reached its operating temperature.

The mentioned memories 125, 127, 138, 139, 140, 141 and 142 are read out staggered by a multiplexing stage 144 and the stored multi-bit values or terms serve for the selection of memory addresses within the memory unit 24.

A large number of set of characteristic curves or performance graphs are stored in the memory unit 24. These performance graphs are arranged in FIG. 6 in three rows whereby, of course, this arrangement has no relationship with the spatial arrangement of the memory locations inside of the memory.

A first performance graph (set of characteristic curves) is a base ignition performance graph 27. Corresponding ignition angles are stored thereat as digital terms for respectively 32 rotational speed values and 64 load values. Two base ignition performance graphs 27 are present which are selected in dependence on the actual suction air temperature. It is also Possible to provide further base performance graphs which are selected at other suction air temperatures or at further characteristic values. A first correction performance graph 28 contains with a resolution of 8 rotational speed values and 32 load values correction values corresponding to the mixture pre-selection. Eight such correction graphs 28 for different mixture adjustments are present corresponding to the eight differing mixture adjustments which are represented by the three-bit term in the memory 127. These correction performance graphs contain each correction values for the ignition angle corresponding to the adjusted mixture composition in order that different mixtures can be taken into consideration. A further correction performance graph 29 provides for 64 lambda-difference values and 32 load values a correction of the ignition angle. This correction performance graph 29 enables on the basis of a difference between the lambda-desired value and the lambda-actual value a correction of the ignition angle. Finally, an acceleration correction graph 30 is present eight times. The memory values are selectable according to 8 rotational speed values and 32 load values. Corresponding to the three-bit acceleration value stored in the memory 140, one of these correction performance graphs is selected. No correction takes place for the acceleration value 0.

The performance graphs for the mixture control, i.e., for the adjustment of the gas pressure adjusting device 22 are indicated in the center row of the memory unit 24. Initially a base performance graph (set of characteristic curves) 31 having 64 rotational speed values and 64 load values is effective. This base performance graph 31 contains adjusting values for the gas pressure adjusting device 22. These adjusting values may be evaluated depending on the construction of the gas pressure adjusting device as cyclic value for a cyclically operated valve, i.e., operated with varying pulse duty factors, as displacement values for a current controlled valve or as angle values for a valve flap. Furthermore, a correction performance graph 33 for the mixture pre-selection, a lambda-difference value-correction performance graph 34 and an acceleration correction performance graph 35 are provided. These correction performance graphs serve essentially for a similar type of correction as the correction performance graphs described hereinabove for the ignition angle.

In the lower row of the memory unit 24, performance graphs for the mixture regulation are provided. This mixture regulation contains a base performance graph 36 which contains lambda-desired values in dependence on 64 rotational speed values and 64 load values. These desired values are corrected by a correction performance graph 37 for the mixture pre-selection. The corrected lambda-desired values are inputted into the comparator 133 at the point A. A lambda-difference value is formed together with the lambda-actual value. This lambda-difference value serves for the correction of the ignition and mixture control with the assistance of the correction performance graphs 29 and 34 which have been explained hereinabove. The difference between lambda-actual value and lambda-desired value is thus regulated essentially to 0 so that a regulation is superimposed on the control as a result thereof. This regulation operates with a certain delay in order to keep small regulating oscillations. The sampling spreads and changes over long periods of time of an engine can be corrected with this regulation.

The type of the evaluated characteristic magnitudes can be selected differently in dependence on the desired correction and the regulating behavior. Also the number of positions of the bit terms can be selected differently. This depends, inter alia. from the available memory space.

The component stages for the evaluation of the performance graphs and for the readying of the output values are illustrated in FIG. 8. The memory unit 24 also contains data specific to the engine in special memory locations. These engine specific data are read out always at the beginning of a crankshaft rotation by way of an intermediate memory 145 into a memory 146 having a corresponding number of memory locations. The evaluation of these data is not explained in detail.

The eight bit ignition values or terms from the ignition base performance graph 27 are inputted clock-controlled into a counter 147. The respective correction values of the correction performance graphs 28, 29 and 30 are also inputted correct in time into a correction counter 148 and are added the correct sign in the counter 148. The corrected values are transferred to a trigger counter 149 which undertakes the ignition counting, properly speaking. A spacing counter 150 for the further cylinders of the engine is connected in the output of the trigger counter 149. The counted pulses are inputted by way of a distributor stage 151 to a make-time counter 152 . . . 153 for the different cylinders or cylinder groups. The number of the make-time counters is normally equal to the number of the cylinders. One end stage, 154 . . . 155 for producing the ignition pulse is connected in the output of each of the make-time counters 152 . . . 153.

The adjusting values stored in the base performance graph 31 for the gas pressure adjusting device 22 are transferred to a counter 157 for the mixture control. A correction counter 158 is coordinated to the counter 157 which accepts the values of the correction performance graphs 33, 34, 35 and adds the same sign-correct to the content of the correction counter 157. The corrected values of the counter 157 are transferred by way of an intermediate memory 159 to a converter 160 which controls a control stage 161 for the gas pressure adjusting device 22. The output 21 of the control stage 161 may represent a pulse duty factor, a current value or an angle value.

The lambda-desired value from the performance graph 36 is transferred to a counter 162 to which a correction counter 163 is coordinated. The correction counter 163 receives the values of the correction performance graph 37 and adds the same sign-correct to the content of the counter 162. The content of the counter 162 is transferred to an intermediate memory 164 whose output is connected by way of the connection points A-A with an input of the comparator 133. The comparison between the lambda-desired value and the lambda-actual value takes place thereat so that sample deviations and changes over long periods of time of an individual engine can be controllably compensated thereby.

The output stage 167 holds the angle pulse ready as signal 19 for the rotational speed limiter 99. The rotational speed limiter 99 acts at a necessary rotational speed limitation on the throttle valve.

Finally, signals for the coasting turn-off are processed in a circuit stage 169 and are transmitted by way of an output stage 170. The coasting turn-off is effective by way of a blocking stage 168 also for the make-time counter and therewith for the turn-off of the ignition.

Idling output signals 20 are transferred to an output stage 171 by way of an intermediate memory 172 in the course of the program. The idling regulation is not explained herein in detail.

The operation of the regulation can be summarized as follows. FIG. 9 illustrates a toothed rim 3 coupled with the crankshaft and having a corresponding number of teeth which serve for generating tooth pulses. The number of teeth is dependent on the installation. The doubling of the tooth pulses is disregarded in this discussion. The tooth flanks are instead viewed directly as angle pulses. An operating period begins in each case at a reference angle or a reference time T0. During a first angle section, the counters, in particular the time base counter, are set to "0" and engine specific data are transferred to the memory 146. The contents of the memories are evaluated in the course of the program by the microprocessor. This is not explained in detail.

With the aid of the time base counter 123, the rotational speed is determined in the counter circuit 124. The actual value of the rotational speed is stored in the memory 125 as a seven-bit term. The three-bit term for the respective mixture is always ready in the memory 127. The memory 138 contains a six-bit lambda-difference value. The memory 139 contains a six-bit temperature value for the suction air temperature. The memory 140 contains a three-bit acceleration value. The memory 141 contains a six-bit lambda value, and the memory 142 contains a six-bit load value. These values or terms are ready during each operating period by reason of the measurement which has taken place in the preceding operating period. The control takes place by a clock generator of the microprocessor 17 with an operating frequency in the Megahertz range.

During each operating period, the memory 139 is read out at an angle value T1. The stored temperature value is compared in a subprogram with a programmed switch-over value of the temperature. The selection of the ignition base performance graph 27 takes place depending on whether the actual temperature exceeds the switch-over value. A corresponding bit term for the selection of one of the ignition performance graphs 27 is produced. In this time period, also the memories 125 and 142 are read out. The addresses of the performance graphs 31 and 36 are selected with the respective stored values. The values stored in the selected addresses are then transferred under corresponding clock control to the counters 147, 162 and 157.

At an angle value T2, the correction performance graphs 28, 33 and 37 are evaluated. The memories 125, 127 and 142 are read out by way of the multiplexing device. The three-bit term of the memory 127 selects among eight correction performance graphs the desired correct performance graph 28, 33, 37.

The values of the memories 125 and 132 determine the selected memory locations of these correction performance graphs. The corresponding correction values are transferred to the correction counters 148, 158, respectively, 163. The correction values are four-bit terms as well as a sign value. These values are sign-correctly added in the counters 147, 157, 162.

At an angle value T3, the evaluation of the correction performance graphs 29 and 34 is initiated. The lambda-difference value is read out of the memory 138 and the load value out of the memory 142. Corresponding memory locations of the correction performance graphs 29 and 34 are selected or addressed. This correction value permits the regulation of a sample deviation and long time drift of an engine. The correction performance graphs contain such memory values that only a slow correction takes place in order to avoid jump-like changes. These correction values are transferred to the correction counters 148 and 158 and are added sign-correct in the counters 147 and 157.

Finally, an angle value T4 initiates the evaluation of the correction performance graphs 30 and 35. The latter are each eight acceleration performance graphs which are selected by the three-bit term in the memory 140. A correction value corresponding to the rotational speed value of the memory 125 and the load value of the memory 142 are read out in the respective performance graph. The correction values are transferred to the correction counters 142 and 158 and are added sign-correct in the counters 147 and 157.

An angle value T5 then initiates the trigger counting in the trigger counter 149 and the readying of the ignition pulses in the end stages 154 . . . 155 which produce each an ignition pulse in an ignition gap 2.

The adjusting value, respectively, the adjusting signal 21 for the gas pressure adjusting device 22 is available in the control stage 161 so that a corresponding mixture control takes place in the gas mixing device 6.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A control system for an internal combustion engine provided with an ignition pulse generator having adjustable ignition angle characteristics comprising:

(a) adjustment means for receiving a control signal and for adjusting the ignition angle of the ignition pulse generator in response thereto;

(b) means for determining engine rotational speed;

(c) means for determining engine load;

(d) means for determining a base ignition angle as a function of engine load and engine rotational speed;

(e) means for determining an actual lambda-value during operation of the internal combustion engine;

(f) means for determining a desired lambda-value as a function of engine rotational speed and engine load;

(g) means for determining a lambda-difference value by comparing the magnitude of the actual lambda-value with the magnitude of the desired lambda-value;

(h) means for determining a correction of the base ignition angle as a function of the magnitude of the lambda-difference value and the engine load; and (i) means for producing the control signal as a function of the corrected base ignition angle and for supplying the control signal to the adjustment means.

2. A control system according to claim 1, further comprising means for determining a correction of the desired lambda-value for a given engine rotational speed and engine load as a function of the type of fuel provided the engine.

3. A control system according to claim 2, wherein the engine has a gas-mixing means for mixing the fuel with air having adjustable fuel flow characteristics comprising:

(a) fuel flow adjustment means for receiving a control signal and for adjusting the fuel flow to the fuel-air mixing means;

(b) means for determining base adjusting values for fuel flow to the engine as a function of engine load and engine rotational speed; and (c) means for producing the control signal as a function of the base adjusting value for fuel flow and for supplying the control signal to the fuel flow adjustment means.

4. A control system according to claim 3, further comprising means for determining a correction of the base adjusting values for fuel flow to the engine as a function of the lambda-difference value.

5. A control system according to claim 4, further comprising means for determining a correction value for at least one of the base ignition angle and the base adjusting value for fuel flow as a function of at least one of a vehicle acceleration value and a fuel quality value.

6. A control system according to claim 3, wherein the fuel flow adjusting means comprises:

a housing divided into first and second sections by a diaphragm, the first section being in fluid communication with a fuel line connected to the gas-mixing means and the second section being in fluid communication with at least a venturi section of the gas-mixing means;

a valve means connected to the diaphragm for controlling the flow of fuel in the fuel line so that when substantially atmospheric pressure exists in the second section, the fuel line is open and as the pressure in the second section diminishes substantially to the pressure of the venturi section, the fuel line is closed; and an adjusting valve connecting the second section to atmospheric pressure, the adjusting valve being continuously adjustable by the fuel flow control signal between opened and closed positions to control the pressure in the first section and thus control the flow of fuel to the gas-mixing means.

7. A control system according to claim 6, further comprising:

a rotatable valve flap positioned in the fuel line between the gas-mixing means and the fuel flow adjusting means and rotatable between open and closed positions;

means for determining a desired angular position of the valve flap as a function of the rotational speed and load of the engine; and means for adjusting the angular position of the valve flap to the desired angular position.

8. A control system according to claim 7, wherein an auxiliary valve connects the second section of the housing to atmospheric pressure.

9. A control system according to claim 8, wherein the gas-mixing means includes a main throttling means.

10. A control system according to claim 9, wherein the gas-mixing means further includes a pre-throttle means.

11. A control system according to claim 10, wherein the pre-throttle means comprises a double roller slide valve having a variable cross-section which is effective at a relatively low flow range.

12. A control system according to claim 1, wherein the means for determining the base ignition angle is a memory means having stored base ignition angle values as a function of the engine rotation speed and the engine load.

13. A control system according to claim 1, wherein the means for determining a desired lambda-value is a memory means having stored desired lambda-values as a function of engine rotational speed and engine load.

14. A control system according to claim 2, wherein the means for determining a correction of the desired lambda-value comprises a memory means having stored lambda-correction values as a function of the given engine rotational speed and engine load for a given type of fuel, 15. A control system according to claim 3, wherein the means for determining a base adjusting valve for fuel flow is a memory means having stored based adjusting values as a function of the engine load and engine rotational speed.

16. A control system according to claim 4, wherein the means for determining a correction of the base adjusting means is a memory means having stored correction values as a function of the lambda-difference value.

17. A control system according to claim 5, wherein the means for determining a correction value for at least one of the base ignition angle and the base adjusting value for fuel flow is a memory means having stored correction values.

* * * * *